US005705327A

United States Patent [19]

Brewer et al.

[11] Patent Number: 5,705,327

[45] Date of Patent: *Jan. 6, 1998

[54] COLOR NEGATIVE FILMS WITH NON-LINEAR CHARACTERISTIC CURVE SHAPE FOR TELECINE TRANSFER APPLICATIONS

[75] Inventors: John Charles Brewer, Rochester; John Tyler Keech, Penfield; John Frank Sawyer, Fairport, all of N.Y.

[73] Assignee: Eastman Kodak Company, Rochester, N.Y.

[ * ] Notice: The term of this patent shall not extend beyond the expiration date of Pat. No. 5,576,128.

[21] Appl. No.: 715,295

[22] Filed: Sep. 16, 1996

Related U.S. Application Data

[62] Division of Ser. No. 349,349, Dec. 5, 1994, Pat. No. 5,561,012.

[51] Int. Cl.[6] ..... G03C 1/46

[52] U.S. Cl. ..... 430/504; 430/502; 430/503; 430/506; 430/508; 430/509; 430/359

[58] Field of Search ..... 430/502, 504, 430/359, 506, 503, 508, 509

[56] References Cited

U.S. PATENT DOCUMENTS

| | | | |
|---|---|---|---|
| 3,740,457 | 6/1973 | Meeussem et al. | 178/5.4 CD |
| 3,849,138 | 11/1974 | Wyckoff | 96/74 |
| 4,161,406 | 7/1979 | Bulloch | 178/5.4 CD |
| 4,680,253 | 7/1987 | Shibahara et al. | 430/504 |
| 4,792,518 | 12/1988 | Kuwashima et al. | 430/505 |
| 4,855,836 | 8/1989 | Shearer | 358/214 |
| 5,003,379 | 3/1991 | Moore, Jr. et al. | 358/54 |
| 5,266,451 | 11/1993 | Schmuck et al. | 430/509 |
| 5,300,381 | 4/1994 | Buhr et al. | 430/30 |
| 5,314,793 | 5/1994 | Chang et al. | 430/506 |
| 5,360,703 | 11/1994 | Chang et al. | 430/506 |
| 5,390,036 | 2/1995 | Buhr et al. | 358/519 |
| 5,391,443 | 2/1995 | Simons et al. | 430/21 |
| 5,428,387 | 6/1995 | Galt et al. | 348/97 |
| 5,500,316 | 3/1996 | Bogdanowicz et al. | 430/21 |
| 5,561,012 | 10/1996 | Brewer et al. | 430/21 |
| 5,576,128 | 11/1996 | Keech et al. | 430/502 |
| 5,576,156 | 11/1996 | Dickerson | 430/502 |

FOREIGN PATENT DOCUMENTS

| | | |
|---|---|---|
| 324471 | 7/1989 | European Pat. Off. . |
| 684511 | 11/1995 | European Pat. Off. . |

OTHER PUBLICATIONS

*The Negative* by Ansel Adams, New York Graphic Society, Boston, MA USA (1981), Chapter 4, "The Zone System", pp. 47–98.

(List continued on next page.)

*Primary Examiner*—Geraldine Letscher
*Attorney, Agent, or Firm*—Andrew J. Anderson

[57] ABSTRACT

Color negative photographic films having red, green and blue color sensitive records, wherein the ratio of the toe area contrast to the mid-scale contrast for each of the red, green and blue color records is less than or equal to 0.80, and either at least two color records having a toe-area contrast less than or equal to 0.42 or a mid-scale contrast less than or equal to 0.55, or the film having a speed rating of ISO 200 or greater. The mid-scale contrast for a color record is defined as the slope of a straight line connecting a point C and and a point D on the characteristic curve of Status M density versus log Exposure for the color record, where points C and D are located by defining a point A on the characteristic curve at a density level 0.1 above minimum density, a point B is located on the characteristic curve at an exposure value +1.0 Log Exposure beyond point A, and points C and D are located at exposure values −0.45 log Exposure and +0.45 log Exposure with respect to point B, respectively. The toe-area contrast is the slope of a straight line connecting a point E and a point F on the characteristic curve, where point E is located at (mid-scale contrast)/6 density units above minimum density, and point F is located at 0.3 log Exposure higher in exposure on the characteristic curve than point E. Use of such a color negative films are particularly advantageous in making telecine transfers.

5 Claims, 1 Drawing Sheet

OTHER PUBLICATIONS

*Engineering Handbook*; Edward Ebfitts, Ed., 8th ed., National Association of Broadcasters, 1992, Ch. 5–8, pp. 933–946, "Film For Television" by Richard W. Bauer.

AGFA XT100, XT125, XTR250, and XT320 Colour Negative Films Technical Data Sheets (16 pages).

Paul Collard, "The Film/Tape Interface", Image Technology, May 1988, pp. 149–154.

1.0 log E
0.45 log E
0.45 log E
0.3 log E
A
B
C
D
E
F
DENSITY
3.0
2.8
2.6
2.4
2.2
2.0
1.8
1.6
1.4
1.2
1.0
0.8
0.6
0.4
0.2
0.0
STEP NUMBER
2
4
6
8
10
12
14
16
18
20

COLOR NEGATIVE FILMS WITH NON-LINEAR CHARACTERISTIC CURVE SHAPE FOR TELECINE TRANSFER APPLICATIONS

This application is a division of Ser. No. 8/349,349 filed Dec. 5, 1994 now U.S. Pat. No. 5,561,012.

FIELD OF THE INVENTION

The invention relates to a color negative film, and more particularly to a motion picture color negative film which has a non-linear characteristic curve shape.

BACKGROUND

Color negative films are a class of photosensitive materials that map the luminance (neutral) and chrominance (color) information of a scene to complementary tonal and hue polarities in the negative film. Light areas of the scene are recorded as dark areas on the color negative film, and dark areas of the scene are recorded as light areas on the color negative film. Colored areas of the scene are recorded as complementary colors in the color negative film: red is recorded as cyan, green is recorded as magenta, blue is recorded as yellow, etc. In order to render an accurate reproduction of a scene, a subsequent process is necessary to reverse the luminance and chrominance information back to those of the original scene. This subsequent process may or may not require another photosensitive material.

In the motion picture industry, there are two common subsequent processes. One such subsequent process is to optically print the color negative film onto another photosensitive material, such as Eastman Color Print Film 5386™, to produce a color positive image suitable for projection. Another subsequent process in the motion picture industry is to transfer the color negative film information or the color print film information into a video signal using a telecine transfer device. Various types of telecine transfer devices are described in *Engineering Handbook*, E. O. Fritts, Ed., 8th edition, National Association of Broadcasters, 1992, Chapter 5.8, pp. 933–946, the disclosure of which is incorporated by reference. The most popular of such devices generally employ either a flying spot scanner using photomultiplier tube detectors, or arrays of charged-coupled devices, also called CCD sensors. Telecine devices scan each negative or positive film frame transforming the transmittance at each pixel of an image into voltage. The signal processing then inverts the electrical signal in the case of a transfer made from a negative film in order to render a positive image. The signal is carefully amplified and modulated, and fed into a cathode ray tube monitor to display the image, or recorded onto magnetic tape for storage.

There is a widely accepted need in the field of color image reproduction for improvements in shadow rendition in telecine transfers. There has been particular dissatisfaction with current system's ability to reproduce shadow areas of images so that they are natural in appearance. In addition, photographers and cinematographers desire the noise level in their images to be as low as possible.

To minimize image noise in color negative films, cinematographers strive to use the slowest, finest grain stocks that lighting conditions permit. Unfortunately, in many circumstances lighting conditions cannot be altered, either because of the subject material or location constraints. The cinematographer has no choice but to use the most sensitive, albeit the noisiest, stocks available. Medium and high speed color negative stocks are often used in these applications. Film speeds of ISO 200 and greater are preferred for applications containing critical shadow detail. The only recourse for improved shadow rendition is either negative flashing or changes in scene lighting. Flashing is a burdensome process in that iterations are often required to determine what exposure/flash level combinations will give the desired results. Flashing by its very nature results in an undesirable reduction in the negative's available dynamic range. Lighting changes are similarly troublesome. Given time, financial, and equipment constraints, it is often difficult if not impossible to specifically direct auxiliary lighting to increase the exposure values of specific shadow areas.

Since noise is proportional to image density (*The Theory of The Photographic Process*, T. H. James, Ed., 4th edition, Macmillan Publishing Co., 1977, Chapter 21, p625, eq. 21.101), one recourse to noise reduction is to lower image densities everywhere by overall contrast lowering. While this accomplishes noise reduction it does not improve shadow reproduction. When through telecine adjustments shadow information is presented at visible brightness levels, the accompanying midtone reproduction contrast is too flat (i.e. too low).

While color print films have been designed specifically for use in making positives for telecine transferring, use of such print films adds additional processing steps and costs to forming a telecine transfer, and image information from the color negative can be lost in the print step. Accordingly, it would be desirable to make improved telecine transfers possible directly from a color negative film.

SUMMARY OF THE INVENTION

One embodiment of the invention comprises an unexposed color negative photographic film comprising red, green and blue color sensitive records, wherein the ratio of the toe area contrast to the mid-scale contrast for each of the red, green and blue color records is less than or equal to 0.80, and at least two color records have a toe-area contrast less than or equal to 0.42 or a mid-scale contrast less than or equal to 0.55, wherein the mid-scale contrast for a color record is defined as the slope of a straight line connecting a point C and and a point D on the characteristic curve of Status M density versus log Exposure for the color record, where points C and D are located by defining a point A on the characteristic curve at a density level 0.1 above minimum density, a point B is located on the characteristic curve at an exposure value +1.0 Log Exposure beyond point A, and points C and D are located at exposure values −0.45 log Exposure and +0.45 log Exposure with respect to point B, respectively, and the toe-area contrast is the slope of a straight line connecting a point E and a point F on the characteristic curve, where point E is located at (mid-scale contrast)/6 density units above minimum density, and point F is located at 0.3 log Exposure higher in exposure on the characteristic curve than point E.

A second embodiment of the invention comprises an unexposed color negative photographic film comprising red, green and blue color sensitive records and having a rated film speed of 200 ISO or greater, wherein the ratio of the toe area contrast to the mid-scale contrast for each of the red, green and blue color records is less than or equal to 0.80.

A further embodiment of the invention comprises a process of forming a telecine transfer image having enhanced shadow detail comprising exposing a film as described in either of the above embodiments, processing the exposed film to form a developed image, and converting the developed image into video signals representative of the developed image with a telecine transfer device.

The invention is directed towards a color negative photosensitive material with color records having a non-linear characteristic curve shape that yields an improvement in shadow detail in viewed telecine transfers of the originating material. The invention provides the ability to record original scenes at variety of exposure conditions such that the user may change the reproduction contrast in the shadow areas. The lower contrast of this curve results in noise reduction in telecine transfers. The characteristic curve shape of the invention is especially preferred for films with speeds of IS0 200 or greater, as these films generally are more susceptable to noise generation.

DETAILED DESCRIPTION OF THE INVENTION

Figure 1:
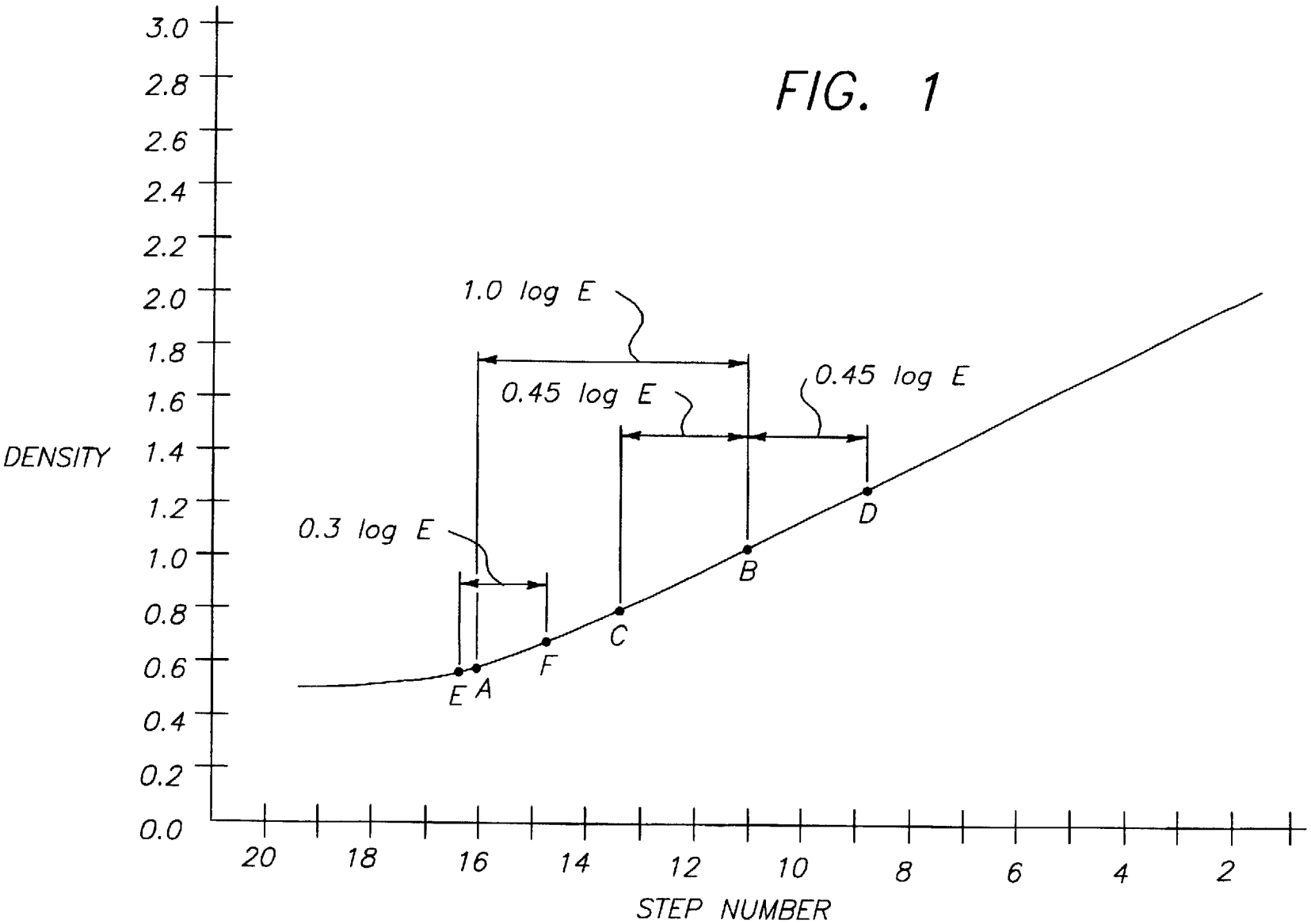
FIG. 1 is a characteristic curve of density versus log E for a color negative film in accordance with the invention.

The invention provides a color negative photosensitive material that, when exposed through a step wedge and read for status M densitometry, the resulting curves of density versus log-E for all the color records have a novel shape, which is responsible for the advantages offered by the invention. To help describe the invention, points and lines are defined on a density versus log-E curve in FIG. 1. The two criteria used in defining the invention are described below.

(1) Mid-scale contrast: A point 0.1 density above minimum density (D-min) is located (Point A). A second point 1.0 log-E higher in exposure is located and labeled B. To obtain two points for a mid-scale contrast calculation, point C is take 0.45 log-E lower and point D is taken 0.45 log-E higher, respectively, in exposure than point B. The mid-scale contrast is the slope of the straight line connecting points C and D.

(2) Toe-area contrast: In order to correctly locate the toe of any sensitometric curve, a factor for overall contrast differences is necessary. Therefore, a new reference point E is defined to be (mid-scale contrast)/6 density units above D-min. Hence for mid-scale contrasts greater than 0.6, the reference point E will be greater than 0.1 density units above D-min and for mid-scale contrasts less than 0.6, the reference point will be less than 0.1 density units above D-min, respectively. The second point F for the toe contrast calculation is located 0.3 log-E higher in exposure on the curve than point E. The toe-area contrast is the slope of the straight line connecting points E and F.

Points E and F are used to define the average gamma in the toe region. Points C and D are used to define the mid-scale contrast of the negative and ultimately the contrast at which midtones are recorded. In order to have discernible noise reduction, the slope of the line connecting points E and F is preferably less than or equal to 0.42 or the slope of the line connecting points C and D is preferably less than 0.55 for at least two, and more preferably for all color records in the photosensitive material.

In order to obtain excellent shadow detail and acceptable mid-scale contrast, the curve shape must be such that the ratio of toe contrast to mid-scale contrast is appropriately low. In accordance with the invention, the ratio of toe contrast to mid-scale contrast must be less than or equal to 0.80 for all the color records in the photosensitive material.

Sensitometric curve shapes for color negative photosensitive materials in accordance with the invention have been found to provide an improvement in shadow reproduction and the ability to vary the reproduction contrast by change in exposure protocol. To increase the visibility of shadow information, one can underexpose the color negative film relative to a normal condition and to decrease shadow visibility, one can overexpose.

In constucting films according to the invention, the required parameters can be achieved by various techniques, examples of which are described below. These techniques are preferably applied to each color record of a silver halide photographic element so that all color records will meet the requirements of the present invention. For example, the toe-area and mid-scale contrast positions exhibited in films according to the the invention may be accomplished by any combination of formulations changes such as reductions in laydowns of silver or image coupler, blend ratio changes of high and low speed emulsions, increased laydowns of image modifying chemistry such as development inhibitor releasing (DIR) or development inhibitor anchimeric releasing (DIAR) couplers, and blend ratio changes of more-active and less-active image couplers. All of these film design tools are well known in the art.

Additionally, some characteristics of color negative films that are optimized to improve the quality of optical prints also improve the quality of the video images obtained using a telecine transfer device, and it is desirable to incorporate such characteristics into the color negative filme of the invention. These characteristics include, e.g., high color saturation, accurate color hue, high Modulation Transfer Function (MTF), and low granularity.

As already described, the photographic elements of the present invention are color elements and contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative, less preferred, format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention will be negative-working emulsions. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, and exposure alternatives in Section XVIII.

The photographic elements of the present invention may also use colored couplers (e.g. to adjust levels of interlayer correction) and masking couplers such as those described in EP 213,490; Japanese Published Application 58–172, 647; U.S. Pat. No. 2,983,608; German Application DE 2,706, 117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps, for example, of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019, 492.

The photographic elements may further contain image-modifying compounds such as "Developer Inhibitor-Releasing" compounds (DIR's). Useful DIR's for elements of the present invention, are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252; 365, 346; 373,382; 376,212; 377,463; 378,236; 384,670; 396, 486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 74 (1969), incorporated herein by reference.

The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540, 653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072, 634; 90-077,822; 90-078,229; 90-078,230; 90-079,336; 90-079,338; 90-079,690; 90-079,691; 90-080,487; 90-080, 489; 90-080,490; 90-080,491; 90-080,492; 90-080,494; 90-085,928; 90-086,669; 90-086,670; 90-087,361; 90-087, 362; 90-087,363; 90-087,364; 90-088,096; 90-088,097; 90-093,662; 90-093,663; 90-093,664; 90-093,665; 90-093, 666; 90-093,668; 90-094,055; 90-094,056; 90-101,937; 90-103,409; 90-151,577.

The silver halide used in the photographic elements of the present invention may be silver bromoiodide, silver bromide, silver chloride, silver chlorobromide, silver chlorobromo-iodide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process*. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., aurous sulfide) and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention may also usefully include a magnetic recording material as described in *Research Disclosure*, Item 34390, November 1992.

Photographic elements of the present invention are motion picture film elements. Such elements typically have a width of up to 100 millimeters (or only up to 70 or 50 millimeters), and a length of at least 30 meters (or optionally at least 100 or 200 meters). The manufactured elements are provided to a user with a speed value of the film indicated on the film or its packaging.

The elements of the present invention may be imagewise exposed with a normal exposure according to the speed value indicated with the film or other manufacturer recommendations, and processed according to the processing conditions indicated on the film or its packaging. This is advantageous in that the film user need not experiment with various under-development conditions or flashing conditions in order to obtain a desired contrast position. The film of the present invention is preferably simply exposed and processed according to the manufacturer's indications without flashing, and the advantages of the film are obtained. These alternative processing techniques, however, can also be used with films according to the invention if desired.

By "indicated" in relation to the film speed and processing conditions, means that some designation is provided on the film or its packaging or associated with one or the other, which allows the user to ascertain the manufacturer's speed rating (or film processing conditions). Such a designation can be a film speed number (such as Film Speed, or ASA Film Speed), or in the case of processing conditions, an actual statement of the conditions or reference to a well-known standard processing method (for example, Kodak ECN-2 processing). Alternatively, such a designation can be a film identification designation (such as a number or film name) which allows a user to match the film with the manufacturer's speed designation or processing conditions (such as from a catalogue, brochure or other source).

The following examples illustrate preparation of photographic elements of the present invention, and their beneficial characteristics.

EXAMPLE 1

The following layers were coated on a transparent base to make films of the following description. All laydowns are in units of milligrams per square meter.

TABLE 1

| Formulation Description. | | | | |
|---|---|---|---|---|
| | Exp 1 | Exp 2 | Exp 3 | Exp 4 |
| Layer 1 | | | | |
| Slow Slow Cyan Emulsion | 0.0 | 0.0 | 0.0 | 489.8 |
| Slow Cyan Emulsion | 468.4 | 472 | 460 | 123.8 |
| Mid Cyan Emulsion | 1093 | 1102 | 1101 | 839.6 |
| Coupler-1 | 312.0 | 213 | 171 | 305.7 |
| Coupler-2 | 17.0 | 40 | 40 | 21.5 |
| Coupler-3 | 65.0 | 65 | 65 | 32.3 |
| Coupler-4 | 25.0 | 25 | 25 | 31.2 |
| Coupler-5 | 27.0 | 27 | 27 | 22.6 |
| Gelatin | 2535 | 2535 | 2535 | 2508 |
| Layer 2 | | | | |
| Fast Cyan Emulsion | 1100 | 1033 | 1100 | 1022.6 |
| Coupler-1 | 77.4 | 23.5 | 5.7 | 29.1 |
| Coupler-3 | 0.0 | 0 | 0.0 | 32.3 |
| Coupler-5 | 27.0 | 27 | 27.0 | 18.3 |
| Gelatin | 1347 | 1347 | 1347 | 1184 |
| Layer 3 | | | | |
| Coupler-6 | 18.3 | 0.0 | 0.0 | 25.8 |
| Coupler-7 | 20.0 | 0.0 | 0.0 | 5.4 |
| Didodecylhydroquinone | 108.0 | 108 | 108 | 107.6 |
| Gelatin | 646.0 | 646 | 646 | 646 |
| Layer 4 | | | | |
| Slow Magenta Emulsion | 990.0 | 1736 | 1736 | 1517.7 |
| Mid Magenta Emulsion | 1483.5 | 738 | 738 | 925.7 |
| Coupler-8 | 420.0 | 360 | 331 | 456.4 |
| Coupler-1 | 42.9 | 0 | 0.0 | 21.5 |
| Coupler-9 | 144.0 | 144 | 144 | 134.5 |
| Coupler-10 | 31.2 | 40 | 40 | 26.4 |
| Gelatin | 2277 | 2277 | 2277 | 2594 |

TABLE 1-continued

Formulation Description.

| | Exp 1 | Exp 2 | Exp 3 | Exp 4 |
|---|---|---|---|---|
| Layer 5 | | | | |
| Fast Magenta Emulsion | 1119 | 1065 | 1035 | 1022.6 |
| Coupler-9 | 21.5 | 21.5 | 21.5 | 18.3 |
| Coupler-11 | 80.7 | 53.5 | 30 | 38.3 |
| Coupler-8 | 18.4 | 18.4 | 18.4 | 18.4 |
| Gelatin | 1290 | 1290 | 1290 | 1238 |
| Layer 6 | | | | |
| Coupler-6 | 18.3 | 0 | 0.0 | 43.1 |
| Didodecylhydroquinone | 168 | 168 | 168 | 168 |
| Dye-1 | 151.0 | 194 | 194 | 150.7 |
| Gelatin | 646 | 646 | 646 | 646 |
| Layer 7 | | | | |
| Slow Yellow Emulsion | 255 | 171 | 171 | 176.5 |
| Mid Yellow Emulsion | 595 | 595 | 594 | 742.7 |
| Coupler-12 | 27 | 27 | 27 | 62.4 |
| Coupler-13 | 480 | 722 | 690 | 411.2 |

TABLE 1-continued

Formulation Description.

| | Exp 1 | Exp 2 | Exp 3 | Exp 4 |
|---|---|---|---|---|
| Coupler-14 | 320 | 13.5 | 13 | 0.0 |
| Coupler-15 | 0.0 | 0 | 0.0 | 330.5 |
| Gelatin | 1700 | 1700 | 1700 | 1700 |
| Layer 8 | | | | |
| Fast Yellow Emulsion | 1614.5 | 1463 | 1267 | 1453.1 |
| Coupler-14 | 320 | 293 | 242 | 300.3 |
| Gelatin | 1641 | 1641 | 1641 | 1615 |

Surfactants were added as coating aids where appropriate as is commonly done in the art. An ultraviolet absorbing layer and a protective overcoat layer were coated over Layer 8. The emulsion specified above and the structures of some of the compounds are listed below.

TABLE 2

Emulsion Descriptions.

| Emulsion | Structure | Iodide % | Diameter | Thickness |
|---|---|---|---|---|
| Slow Slow Cyan | Tabular | 2.3% | 0.64 μm | 0.107 μm |
| Slow Cyan | Tabular | 2.3% | 0.98 μm | 0.114 μm |
| Mid Cyan | Tabular | 4% | 1.90 μm | 0.125 μm |
| Fast Cyan | Tabular | 5% | 3.50 μm | 0.130 μm |
| Slow Magenta | Tabular | 4% | 0.70 μm | 0.101 μm |
| Mid Magenta | Tabular | 4% | 1.80 μm | 0.130 μm |
| Fast Magenta | Tabular | 4% | 4.00 μm | 0.118 μm |
| Slow Yellow | Tabular | 3% | 1.65 μm | 0.120 μm |
| Mid Yellow | Tabular | 5% | 2.60 μm | 0.120 μm |
| Fast Yellow | 3-D | 9% | 2.00 μm | — |

Coupler-1

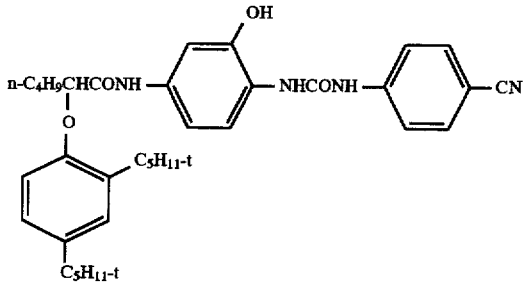

Coupler-2

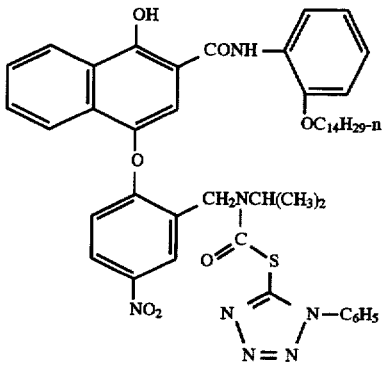

TABLE 2-continued
Emulsion Descriptions.
| Emulsion | Structure | Iodide % | Diameter | Thickness |
|---|---|---|---|---|
| Coupler-3 | 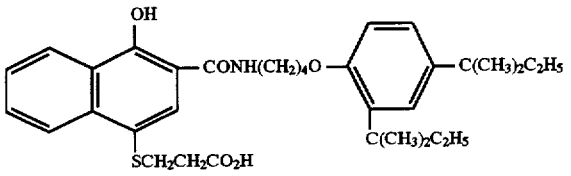 | | | |
| Coupler-4 | 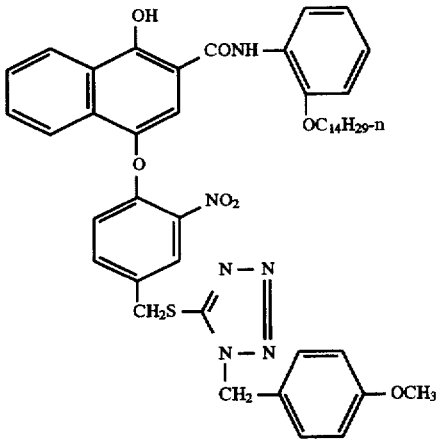 | | | |
| Coupler-5 | 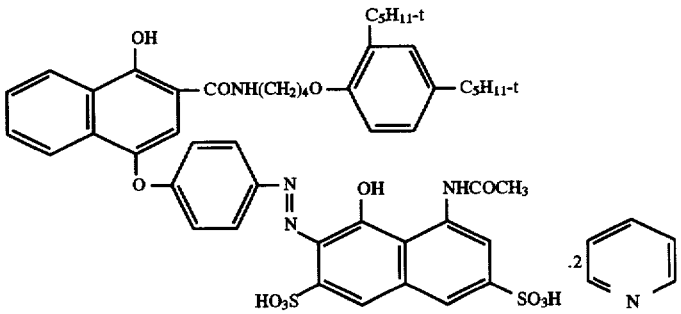 | | | |
| Coupler-6 | 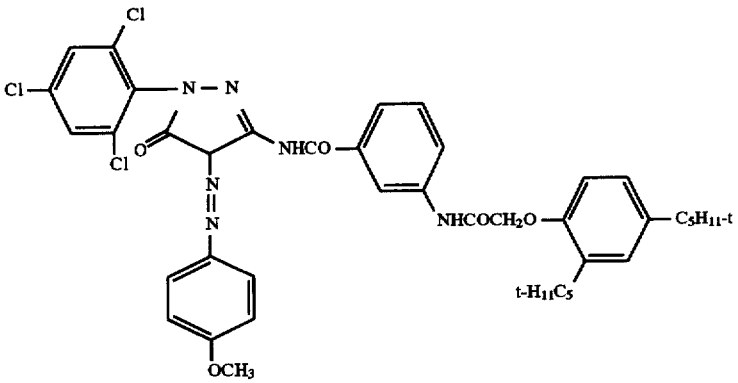 | | | |

TABLE 2-continued
Emulsion Descriptions.
| Emulsion | Structure | Iodide % | Diameter | Thickness |
|---|---|---|---|---|
| | 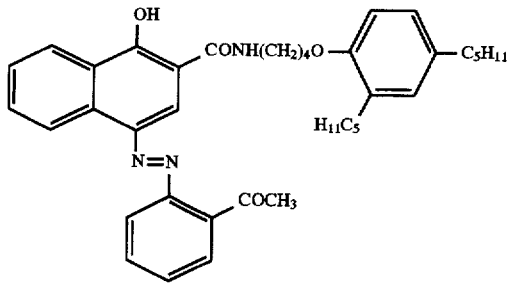 | | | Coupler-7 |
| | 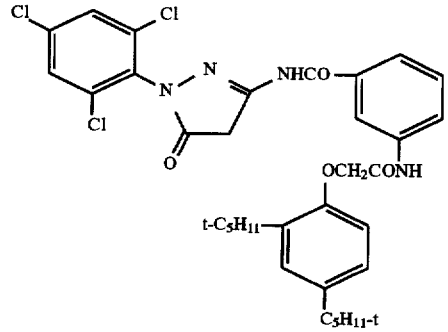 | | | Coupler-8 |
| | 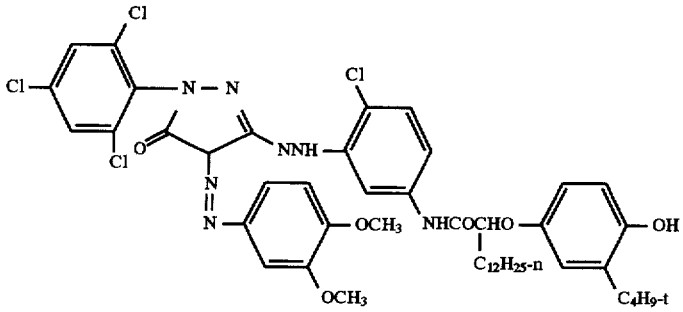 | | | Coupler-9 |
| | 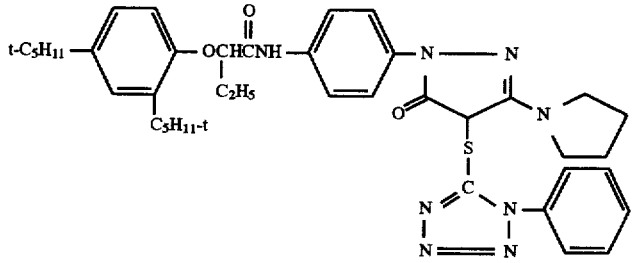 | | | Coupler-10 |
| | 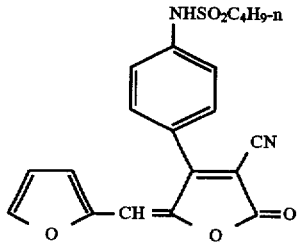 | | | Dye-1 |

TABLE 2-continued
Emulsion Descriptions.
| Emulsion | Structure | Iodide % | Diameter | Thickness |
|---|---|---|---|---|
| Coupler-11 | 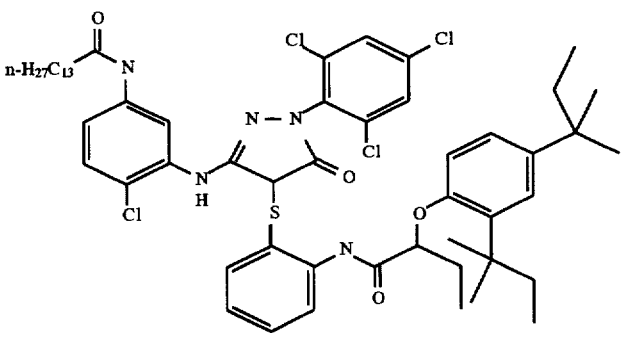 | | | |
| Coupler-12 | 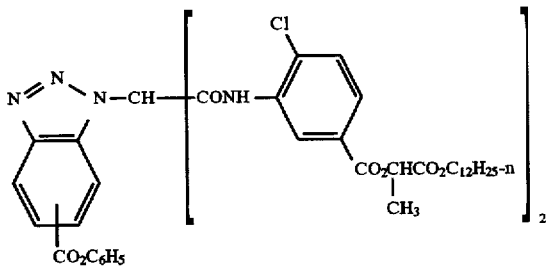 | | | |
| Coupler-13 | 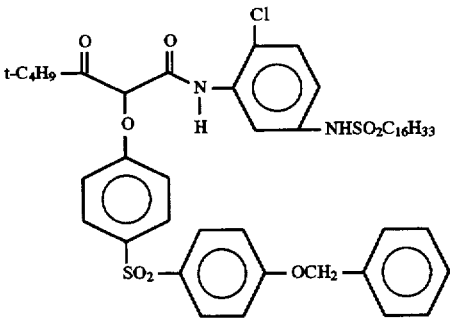 | | | |
| Coupler-14 | 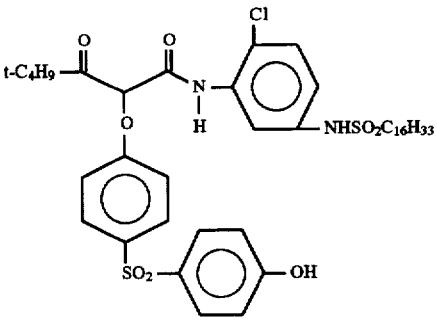 | | | |
| Coupler-15 | 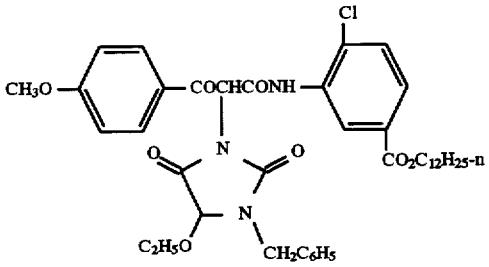 | | | |

The above films were exposed on a Kodak 1B sensitometer with a 3200K light balance. Exposures were adjusted so that a minimum of 0.20 log-E of minimum density resulted on the strips when processed in the Kodak Process ECN-2 as described in the Kodak H-24 Manual, *Manual for Processing Eastman Motion Picture Films*.

The four films were examined for their noise levels and shadow reproduction abilities. All sensitometric samples were read for Status M densitometry. Noise determinations (granularities) were calculated according to standard methods from Status M microdensitometry readings using a 48 micron aperture. Root mean square granularity ($\sigma_D$) was determined using standard root mean square calculations (*The Theory of The Photographic Process*, T. H. James, Ed., 4th edition, Macmillan Publishing Co., 1977, Chapter 21, p619, eq. 21.77). The film samples were transferred to video tape using a Rank Model IIIC telecine device with a Rank Digi-IV analog-to-digital converter unit. A Pandora Pogel controller unit connected to the Rank telecine provided standard color grading capabilities. A Tektronix 1735 Waveform Monitor and a Tektronix 1725 Vectorscope were used to adjust the luminance and chrominance values in the transfer operation to render a high quality image. The video signal was recorded on a BTS DRC100-D-1 recorder. The resulting images were evaluated by 12 professional telecine operators or other industry experts. The results are summarized in Table 3.

TABLE 3

| Sample | Mid-scale Contrast | Toe-area Contrast | Toe-area Contrast to Mid-scale Contrast ratio | Lower scale grain[1] $\sigma_D \times 1000$ | Shadow detail |
|---|---|---|---|---|---|
| exp1 (comparison) | r: 0.52<br>g: 0.59<br>b: 0.63 | r: 0.46<br>g: 0.49<br>b: 0.46 | r: 0.88<br>g: 0.83<br>b: 0.73 | 20.5 | fair |
| exp2 (comparison) | r: 0.40<br>g: 0.40<br>b: 0.47 | r: 0.32<br>g: 0.37<br>b: 0.36 | r: 0.80<br>g: 0.93<br>b: 0.77 | 16.4 | fair |
| exp3 (invention) | r: 0.37<br>g: 0.40<br>b: 0.45 | r: 0.27<br>g: 0.32<br>b: 0.31 | r: 0.73<br>g: 0.80<br>b: 0.69 | 13.6 | excellent |
| exp4 (invention) | r: 0.45<br>g: 0.50<br>b: 0.54 | r: 0.36<br>g: 0.36<br>b: 0.39 | r: 0.80<br>g: 0.72<br>b: 0.72 | 15.3 | excellent |

[1]Color weighted average 30:60:10 (r:g:b)
Lower scale average over 0.2 log-E range Table 3 contains two examples of the invention, exp3 and exp4. The reference position used is exp1, which is a normal contrast high speed negative with conventional curve shape. While exp2 exhibits an overall lower contrast condition which leads to reduction in noise, there is no significant improvement in shadow visibility. In order to observe both a noise reduction and improved shadow rendition, one must have the correct shape at an appropriate lower contrast.

Fulfilling the contrast ratio requirement ensures that the film will have improved shadow rendition along with adequate reproduction contrast in midtone areas. Fulfilling the preferred toe and mid-scale contrast requirements ensures that the film will have the lower densities required for observable noise reduction. These two features are particularly useful for high and medium speed color negative films, on which low light information is often recorded but with suboptimal noise and tonal values.

Advantages

In the current art, if photographers and cinematographers desire reduced noise in their images, they must increase ambient lighting levels so that a slower, finer grain film could be employed. If they desired improved shadow rendition, they would (1) flash the negative but at the expense of acceptable black reproduction or (2) add light to areas not adequately bright. This invention solves these problems by providing a color photosensitive material that simultaneously has lower noise, maintains blacks, and improves the rendition of shadow information in telecine transfers.

While the invention has been described in detail with particular reference to preferred embodiments, it will be understood that variations and modifications can be effected within the spirit and scope of the invention.

We claim:

1. An unexposed color negative photographic film comprising red, green and blue color sensitive silver halide emulsion records, wherein the ratio of the toe-area contrast to the mid-scale contrast for each of the red, green and blue color records is less than or equal to 0.80, and at least two of the color records have a mid-scale contrast less than or equal to 0.55 or a toe-area contrast less than or equal to 0.42, wherein (a) the mid-scale contrast for a color record is defined as the slope of a straight line connecting a point C and and a point D on the characteristic curve of Status M density versus log Exposure for the color record, where points C and D are located by defining a point A on the characteristic curve at a density level 0.1 above minimum density, a point B is located on the characteristic curve at an exposure value +1.0 Log Exposure beyond point A, and points C and D are located at exposure values −0.45 log Exposure and +0.45 log Exposure with respect to point B, respectively, and (b) the toe-area contrast is the slope of a straight line connecting a point E and a point F on the characteristic curve, where point E is located at (mid-scale contrast)/6 density units above minimum density, and point F is located at 0.3 log Exposure higher in exposure on the characteristic curve than point E.

2. An unexposed color negative photographic film according to claim 1 wherein each of the red, green and blue color records has a mid-scale contrast less than or equal to 0.55 or a toe-area contrast less than or equal to 0.42.

3. An unexposed color negative photographic film comprising red, green and blue color sensitive silver halide emulsion records and having a rated film speed of 200 ISO or greater, wherein the ratio of the toe-area contrast to the mid-scale contrast for each of the red, green and blue color records is less than or equal to 0.80, wherein (a) the mid-scale contrast for a color record is defined as the slope of a straight line connecting a point C and a point D on the characteristic curve of Status M density versus log Exposure for the color record, where points C and D are located by defining a point A on the characteristic curve at a density level 0.1 above minimum density, a point B is located on the characteristic curve at an exposure value +1.0 Log Exposure beyond point A, and points C and D are located at exposure values −0.45 log Exposure and +0.45 log Exposure with respect to point B, respectively, and (b) the toe-area contrast is the slope of a straight line connecting a point E and a point F on the characteristic curve, where point E is located at (mid-scale contrast)/6 density units above minimum density, and point F is located at 0.3 log Exposure higher in exposure on the characteristic curve than point E.

4. An unexposed color negative photographic film according to claim 3 wherein at least two of the color records have a mid-scale contrast less than or equal to 0.55 or a toe-area contrast less than or equal to 0.42.

5. An unexposed color negative photographic film according to claim 4, wherein each of the red, green and blue color records has a mid-scale contrast less than or equal to 0.55 or a toe-area contrast less than or equal to 0.42.

* * * * *